US010450991B2

(12) United States Patent
Miyata et al.

(10) Patent No.: US 10,450,991 B2
(45) Date of Patent: Oct. 22, 2019

(54) FUEL INJECTION CONTROL APPARATUS OF INTERNAL COMBUSTION ENGINE

(71) Applicant: MITSUBISHI JIDOSHA KOGYO KABUSHIKI KAISHA, Tokyo (JP)

(72) Inventors: Toshiyuki Miyata, Okazaki (JP); Hitoshi Toda, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 479 days.

(21) Appl. No.: 14/801,605

(22) Filed: Jul. 16, 2015

(65) Prior Publication Data

US 2016/0017819 A1 Jan. 21, 2016

(30) Foreign Application Priority Data

Jul. 17, 2014 (JP) ..... 2014-147213

(51) Int. Cl.

| | |
|---|---|
| ***F02D 41/30*** | (2006.01) |
| *F02M 63/02* | (2006.01) |
| *F02D 41/38* | (2006.01) |
| *F02D 41/40* | (2006.01) |

(52) U.S. Cl.

CPC ..... *F02D 41/3094* (2013.01); *F02D 41/3845* (2013.01); *F02D 41/406* (2013.01); *F02M 63/0285* (2013.01)

(58) Field of Classification Search

CPC ..... F02D 2250/31; F02D 41/3094; F02D 41/3845; F02D 2041/3881; F02D 2041/389; F02D 2200/0602; F02D 41/10; F02D 41/126; F02D 41/3836; F02D 41/40; F02D 41/407; F02M 63/024; F02M 69/046; Y02T 10/04

See application file for complete search history.

(56) References Cited

U.S. PATENT DOCUMENTS

| | | | | |
|---|---|---|---|---|
| 6,892,527 | B2 * | 5/2005 | Ueda | F01N 11/00 123/198 F |
| 9,175,599 | B2 * | 11/2015 | Pursifull | F01B 1/02 |
| 9,920,705 | B2 * | 3/2018 | Mosburger | F02D 41/04 |
| 2003/0056752 | A1 * | 3/2003 | Sukegawa | F02B 1/12 123/305 |
| 2006/0005812 | A1 * | 1/2006 | Mashiki | F02D 41/10 123/431 |

(Continued)

FOREIGN PATENT DOCUMENTS

| | | | |
|---|---|---|---|
| JP | 2014-62553 | A | 4/2014 |
| WO | WO 2006/038428 | A1 | 4/2006 |

*Primary Examiner* — Carl C Staubach

(74) *Attorney, Agent, or Firm* — Birch, Stewart, Kolasch & Birch, LLP

(57) ABSTRACT

A fuel injection control apparatus of an internal combustion engine, capable of controlling the amount of fuel, which is injected from a cylinder injection valve (second fuel injection valve), with high accuracy even when its amount is small, regardless of the operating state of the internal combustion engine, is provided. The fuel injection control device has a fuel pressure adjustment means which, when the injection form of the internal combustion engine is changed, adjusts the working state of a high pressure supply pump such that the amount of fuel injection from the second fuel injection valve stabilizes, before changing the working state of the high pressure supply pump in accordance with the injection form.

20 Claims, 5 Drawing Sheets

(56) References Cited

U.S. PATENT DOCUMENTS

| | | | | |
|---|---|---|---|---|
| 2006/0207563 | A1* | 9/2006 | Kinose | F02D 41/3094<br>123/431 |
| 2009/0082942 | A1* | 3/2009 | Ohsaki | F02D 41/10<br>701/103 |
| 2012/0022771 | A1* | 1/2012 | Kita | F02D 41/32<br>701/104 |
| 2013/0000599 | A1* | 1/2013 | Okamoto | F02D 41/065<br>123/295 |
| 2016/0017818 | A1* | 1/2016 | Miyata | F02D 41/10<br>701/103 |

* cited by examiner

FUEL INJECTION CONTROL APPARATUS OF INTERNAL COMBUSTION ENGINE

The entire disclosure of Japanese Patent Application No. 2014-147123 filed on Jul. 17, 2014 is expressly incorporated by reference herein.

TECHNICAL FIELD

This invention relates to a fuel injection control apparatus of an internal combustion engine, which is equipped with an intake passage injection valve (first fuel injection valve) for injecting fuel into an intake passage, and a cylinder injection valve (second fuel injection valve) for injecting fuel directly into a combustion chamber.

BACKGROUND ART

Among internal combustion engines (may hereinafter be referred to as "engines") loaded on vehicles, such as automobiles, is one equipped with an intake passage injection valve for injecting fuel into an intake passage, and a cylinder injection valve for injecting fuel directly into a combustion chamber. Fuel injections from the intake passage injection valve and the cylinder injection valve are controlled, as appropriate, by a fuel injection control apparatus installed in the engine.

The fuel injection control apparatus of the engine selectively performs injection by the intake passage injection valve and injection by the cylinder injection valve, for example, in accordance with the load region of the engine. Concretely, there is a fuel injection control apparatus designed to inject fuel only from the intake passage injection valve for injecting fuel into the intake passage when the operating state of the engine is in a low rotation, low load operating region, and to inject fuel from each of the cylinder injection valve and the intake passage injection valve when the operating state of the engine is in a high rotation, high load operating region (see Patent Document 1).

PRIOR ART DOCUMENTS

Patent Documents

[Patent Document 1] JP-A-2014-62553

SUMMARY OF THE INVENTION

Problems to be Solved by the Invention

As mentioned above, the cylinder injection valve injects fuel directly into the combustion chamber. Depending on the timing of injection, therefore, the pressure of fuel (fuel pressure) to be supplied to the cylinder injection valve needs to be rendered relatively high. For this purpose, the engine equipped with the intake passage injection valve and the cylinder injection valve has a high pressure supply pump capable of supplying fuel at a higher pressure than the pressure of fuel to be supplied to the intake passage injection valve, and is adapted to supply fuel to the cylinder injection valve at a predetermined pressure via this high pressure supply pump. In recent years, some high pressure supply pumps have been configured to be capable of changing output in a plurality of stages and supplying fuel to the cylinder injection valve at different pressures.

Increases in the fuel pressure of the cylinder injection valve, however, pose the problem of difficulty in controlling the injection amount with high accuracy when injecting a small amount of fuel from the cylinder injection valve.

The present invention has been accomplished in the light of the above-described circumstances. It is an object of this invention to provide a fuel injection control apparatus of an internal combustion engine which can control the amount of fuel, which is injected from a cylinder injection valve (second fuel injection valve), with high accuracy even when its amount is small, regardless of the operating state of the internal combustion engine.

Means for Solving the Problems

A first aspect of the present invention for solving the above problems is a fuel injection control apparatus of an internal combustion engine, including: a first fuel injection valve for injecting fuel into an intake passage of the internal combustion engine; a second fuel injection valve for directly injecting fuel into a combustion chamber of the internal combustion engine; and a high pressure supply pump for supplying fuel to the second fuel injection valve so as to impart a predetermined fuel pressure higher than the fuel pressure of the first fuel injection valve, the fuel injection control apparatus comprising: fuel injection control means which controls fuel injections from the first fuel injection valve and the second fuel injection valve in accordance with the operating state of the internal combustion engine to change an injection form; and fuel pressure adjustment means which controls the working state of the high pressure supply pump in accordance with the injection form to adjust the fuel pressure of the second fuel injection valve and, when the injection form has been changed by the fuel injection control means, adjusts the working state of the high pressure supply pump such that the amount of fuel injection from the second fuel injection valve stabilizes, before changing the working state of the high pressure supply pump in accordance with the injection form.

A second aspect of the present invention is the fuel injection control apparatus of an internal combustion engine according to the first aspect, wherein the fuel pressure adjustment means maintains the working state of the high pressure supply pump for a predetermined period of time before changing the working state of the high pressure supply pump in accordance with the injection form, when the injection form has been changed by the fuel injection control means.

A third aspect of the present invention is the fuel injection control apparatus of an internal combustion engine according to the second aspect, wherein the fuel pressure adjustment means maintains the working state of the high pressure supply pump until the operating state of the internal combustion engine becomes a steady state, as the predetermined period of time.

A fourth aspect of the present invention is the fuel injection control apparatus of an internal combustion engine according to any one of the first to third aspects, wherein the fuel injection control means allows only the first fuel injection valve to inject fuel when the operating state of the internal combustion engine is in a first operating region defined by the rotation number and load of the internal combustion engine, or allows each of the first fuel injection valve and the second fuel injection valve to inject fuel when the operating state of the internal combustion engine is in a second operating region exceeding the first operating region; and the fuel pressure adjustment means adjusts the working state of the high pressure supply pump such that the amount of fuel injection from the second fuel injection valve stabilizes, when the operating state shifts from the first operating region to the second operating region.

A fifth aspect of the present invention is the fuel injection control apparatus of an internal combustion engine according to the fourth aspect, wherein the high pressure supply pump is adapted to be capable of adjusting the fuel pressure in a plurality of stages in accordance with the operating state of the internal combustion engine; and the fuel pressure adjustment means adjusts the working state of the high pressure supply pump such that the fuel pressure selected from the plurality of stages becomes a fuel pressure at which the amount of fuel injection from the second fuel injection valve stabilizes, when the operating state of the internal combustion engine shifts from the first operating region to the second operating region.

A sixth aspect of the present invention is the fuel injection control apparatus of an internal combustion engine according to the fifth aspect, wherein the fuel pressure adjustment means maintains the working state of the high pressure supply pump such that the fuel pressure of the second fuel injection valve is a fuel pressure at the lowest stage.

A seventh aspect of the present invention is the fuel injection control apparatus of an internal combustion engine according to any one of the fourth to sixth aspects, wherein the fuel injection control means allows the first fuel injection valve to inject fuel in an exhaust stroke, and also allows the second fuel injection valve to additionally inject fuel in an amount, which compensates for fuel injection from the first fuel injection valve in the exhaust stroke, in at least one of an intake stroke and a compression stroke, when the operating state of the internal combustion engine shifts to the second operating region.

Effects of the Invention

According to the present invention, the working state of the high pressure supply pump is controlled to adjust the fuel pressure of the cylinder injection valve (second fuel injection valve). By so doing, the amount of fuel injection from the cylinder injection valve can be controlled with high accuracy, regardless of the injection form. Even if a relative small amount of fuel is injected from the cylinder injection valve, for example, the amount of fuel injection can be controlled highly accurately.

MODE FOR CARRYING OUT THE INVENTION

An embodiment of the present invention will be described in detail with reference to the accompanying drawings.

Figure 1:
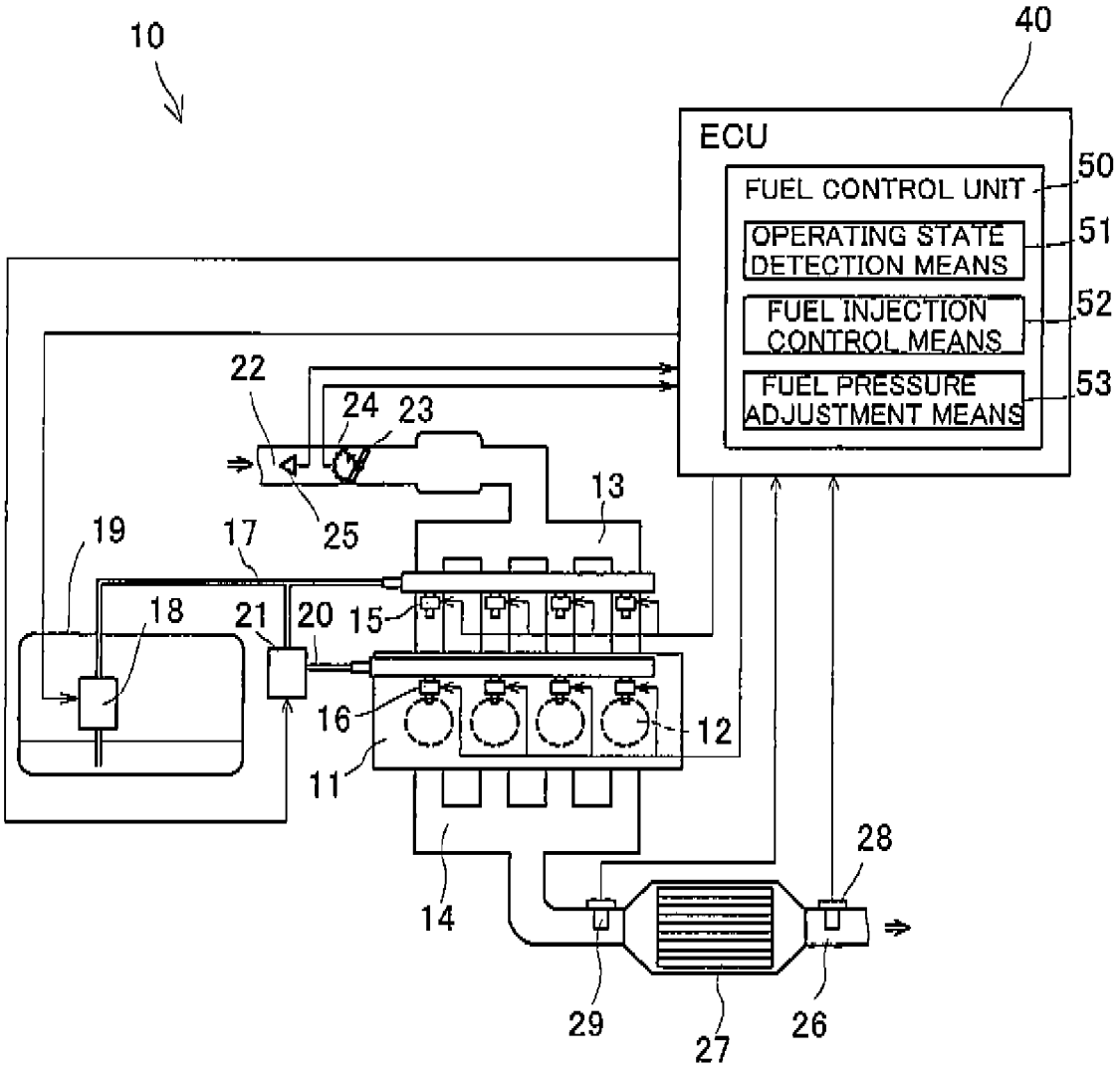
FIG. 1 is a schematic view showing the entire configuration of an engine according to an embodiment of the present invention.

First of all, an explanation will be offered for the entire configuration of an engine 10 according to the embodiment of the present invention. FIG. 1 is a view showing the schematic configuration of the engine according to the present invention.

The engine 10 shown in FIG. 1 is a manifold fuel injection (multi-point injection) multi-cylinder engine, for example, an in-line 4-cylinder 4-stroke engine, and has tour cylinders 12 installed in parallel in an engine body 11. In each cylinder (combustion chamber) 12, a spark plug is arranged, and an intake port and an exhaust port are provided, although they are not shown. The engine body 11 is equipped with an intake manifold 13 connected to the intake port, and an exhaust manifold 14 connected to the exhaust port.

The engine body 11 is also provided with intake passage injection valves (first fuel injection valves) 15 for injecting fuel into an intake passage, for example, near the intake port, of the engine 10, and cylinder injection valves (second fuel injection valves) 16 for directly injecting fuel into each cylinder (combustion chamber) of the engine 10.

The intake passage injection valve 15 is connected to a low pressure supply pump 18 via a low pressure delivery pipe 17. The low pressure supply pump 18 is disposed, for example, within a fuel tank 19. Fuel within the fuel tank 19 is supplied to the low pressure delivery pipe 17 by the low pressure supply pump 18, and supplied to the intake passage injection valve 15 via the low pressure delivery pipe 17.

The cylinder injection valve 16 is connected to a high pressure supply pump 21 via a high pressure delivery pipe 20. The high pressure supply pump 21 is connected to the low pressure supply pump 18 via the low pressure delivery pipe 17. That is, the low pressure delivery pipe 17 led out from the fuel tank 19 is divided into two branches, one of the branches being connected to the intake passage injection valves 15, and the other branch being connected to the high pressure supply pump 21. The fuel within the fuel tank 19 is supplied to the intake passage injection valve 15 and, at the same time, to the high pressure supply pump 21, by the low pressure supply pump 18 via the low pressure delivery pipe 17 as mentioned above.

The high pressure supply pump 21 is adapted to be capable of supplying the fuel, which has been supplied via the low pressure delivery pipe 17, to the high pressure delivery pipe 20 at a higher pressure. That is, the high pressure supply pump 21 is adapted to be capable of supplying fuel to the cylinder injection valve 16 at a higher fuel pressure than the pressure of fuel to be supplied to the intake passage injection valve 15 (fuel pressure of the intake passage injection valve 15). The high pressure supply pump 21 can also adjust the fuel pressure of the cylinder injection valve 16 in a plurality of stages. In the present embodiment, the high pressure supply pump 21 can adjust the fuel pressure of the cylinder injection valve 16 in two stages, i.e., to the first fuel pressure (e.g., a value of the order of 10 MPa) and the second fuel pressure higher than the first fuel pressure (e.g., a value of the order of 20 MPa), in accordance with the operating state of the engine 10, as will be described in detail later.

As the low pressure supply pump 18 and the high pressure supply pump 21, existing pumps may be adopted, and their configurations are not restricted.

An intake pipe (intake passage) 22 connected to the intake manifold 13 is provided with a throttle valve 23, and also has a throttle position sensor (TPS) 24 for detecting the valve opening of the throttle valve 23. Further, an air flow sensor 25 for detecting the amount of intake air is provided upstream of the throttle valve 23. In an exhaust pipe (exhaust passage) 26 connected to the exhaust manifold 14, a three-way catalyst 27, a catalyst for exhaust purification, is interposed. An $O_2$ sensor 28 for detecting the $O_2$ concentration of an exhaust gas after passage through the catalyst is provided on the outlet side of the three-way catalyst 27. A linear air-fuel ratio sensor (LAFS) 29 for detecting the air-fuel ratio of an exhaust gas (exhaust air-fuel ratio) before passage through the catalyst is provided on the inlet side of the three-way catalyst 27.

The engine 10 also has an electronic control unit (ECU) 40, and the ECU 40 includes an input-output device, a storage device for storing a control program, a control map, etc., a central processing unit, timers, and counters. Based on information from various sensors, the ECU 40 exercises the integrated control of the engine 10. To the ECU 40, various sensors, including the above-mentioned throttle position sensor (TPS) 24, air flow sensor 25, $O_2$ sensor 28, and LAFS 29 as well as a crank angle sensor are connected. The ECU 40 exercises various types of control based on detection information from these sensors.

The fuel injection control apparatus of an internal combustion engine according to the present invention is constituted by the above-described ECU and, as will be described below, controls, as appropriate, the amounts of fuel injected from the intake passage injection valve 15 and the cylinder injection valve 16 in accordance with the operating state of the engine 10.

The ECU 40 has a fuel control unit 50 as a fuel injection control apparatus of an internal combustion engine, and the fuel control unit 50 has an operating state detection means (device) 51, a fuel injection control means (device) 52, and a fuel pressure adjustment means (device) 53.

The operating state detection means 51 detects the operating state of the engine 10 based on information from the above-mentioned various sensors, for example, changes in the load and rotation number (rotational speed) of the engine 10. In the present embodiment, for example, the operating state detection means 51 refers to a predetermined operating region map or the like (see FIG. 2), and determines which operating region the operating state of the engine 10 is in, and also determines whether the operating state of the engine 10 is a steady state, or a transient state during vehicle acceleration or the like.

Figure 2:
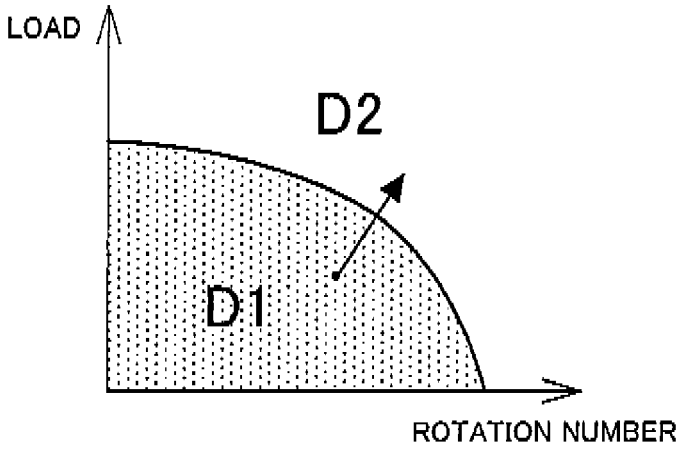
FIG. 2 is a view showing an example of a map defining the operating regions of the engine.

The operating region map is preset based on the rotation number and load of the engine 10, for example, as shown in FIG. 2. In this example, the operating state of the engine 10 is set in two forms, a first operating region D1 which is an operating region on a low rotation low load side, and a second operating region D2 which is an operating region on a high rotation high load side as compared with the first operating region D1.

The fuel injection control means 52 selects a fuel injection mode (injection form) in accordance with the operating state of the engine 10, namely, the detection results of the operating state detection means 51, to control, as appropriate, the amounts of fuel to be injected from the intake passage injection valve 15 and the cylinder injection valve 16. In the present embodiment, for example, when the operating state of the engine 10 is a steady state, the fuel injection control means 52 functions as follows: If the operating state of the engine 10 is in the first operating region D1, the fuel injection control means 52 selects and executes the mode of injecting fuel only from the intake passage injection valves 15 (hereinafter referred to as "MPI injection mode"). If the operating state of the engine 10 is in the second operating region D2, the fuel injection control means 52 selects and executes the mode of injecting fuel from the intake passage injection valves 15 and the cylinder injection valves 16 at a predetermined injection amount ratio (hereinafter referred to as "MPI+DI injection mode").

In the "MPI+DI injection mode", the injection amount ratio between the intake passage injection valves 15 and the cylinder injection valves 16 is preset and, with the present embodiment, the injection amount ratio between the intake passage injection valves 15 and the cylinder injection valves 16 has been set, in principle, at a constant value. If the operating state of the engine 10 is a steady state, changes in the fuel amount required for one combustion cycle (required fuel amount) are minimal. Thus, the injection amount of the intake passage injection valve 15 and the injection amount of the cylinder injection valve 16 are at the above preset ratio.

If the operating state of the engine 10 is a transient state, the required fuel amount changes (increases), as appropriate, in accordance with a change in the operating state of the engine 10. For example, if the operating state of the engine 10 shifts from the first operating region D1 to the second operating region D2, as indicated by an arrow in FIG. 2, the required fuel amount changes (increases), as appropriate. In response to this change in the operating state of the engine 10, therefore, the fuel injection control means 52 switches the fuel injection mode from the "MPI injection mode" to the "MPI+DI injection mode", and also allows the cylinder injection valve 16 to perform additional injection at a predetermined timing, thereby adjusting, as appropriate, the amount of fuel injected from the cylinder injection valve 16. In this case, the injection amount of the intake passage injection valve 15 and the injection amount of the cylinder injection valve 16 may slightly deviate from the above ratio.

In connection with the timings of fuel injections from the intake passage injection valve 15 and the cylinder injection valve 16 in the "MPI+DI injection mode", a plurality of injection patterns have been set, and the fuel injection control means 52 makes a selection from among them, as appropriate, in accordance with the operating state of the engine 10. An example of the injection patterns for fuel from the intake passage injection valve 15 and the cylinder injection valve 16 will be described by reference to FIGS. 3A, 3B and FIG. 4.

Figure 3A:
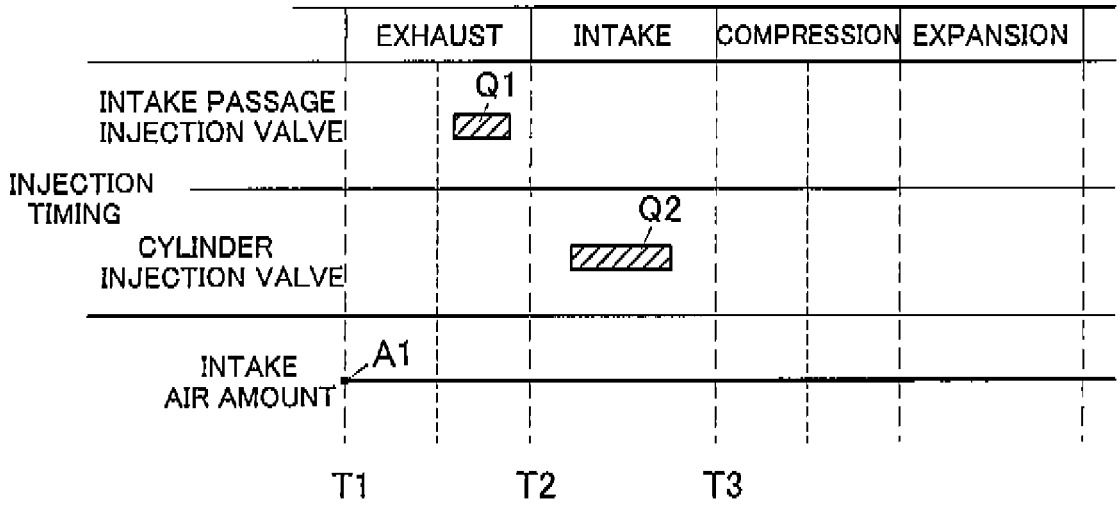
FIGS. 3A, 3B are views illustrating an example of fuel injection patterns and methods for computing fuel injection amounts.
Figure 3B:
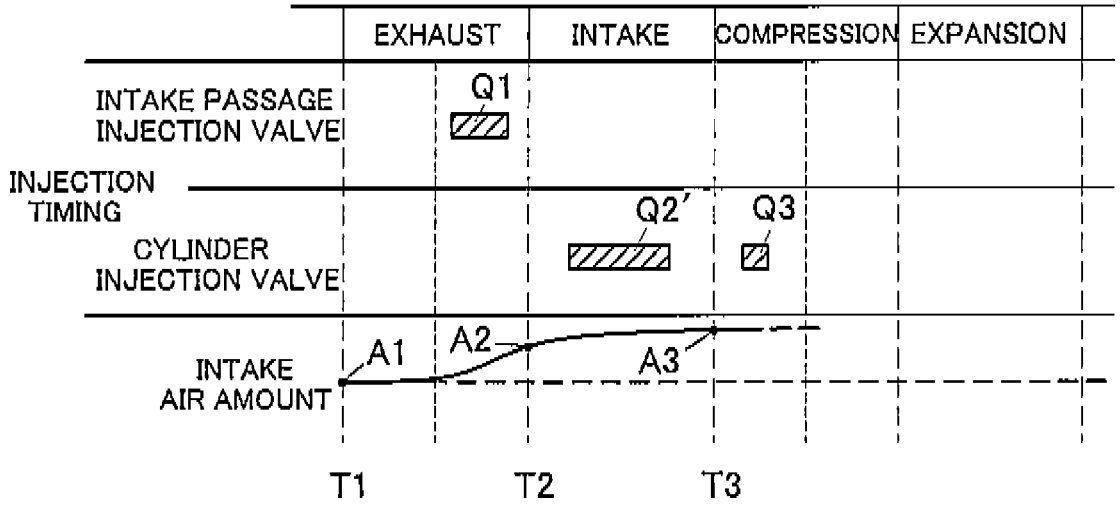

In the example shown in FIGS. 3A, 3B, the timing of fuel injection from the intake passage injection valve 15 (timing of valve opening) is set at an exhaust stroke. The timing of fuel injection from the cylinder injection valve 16 is set at an intake stroke, as shown in FIG. 3A, if the operating state of the engine 10 is a steady state. If the operating state of the engine 10 is a steady state, moreover, the injection form is fixed. If the operating state of the engine 10 is a transient state, on the other hand, for example, if the operating state of the engine 10 shifts from the first operating region D1 to the second operating region D2, the timing of fuel injection from the cylinder injection valve 16 is set at an intake stroke and a first half of a compression stroke, as shown in FIG. 3B. That is, additional injection from the cylinder injection valve 16 is executed in the first half of the compression stroke. Additional injection need not necessarily be performed in the compression stroke, but may be performed in the intake stroke.

Further, the fuel injection control means 52 computes the valve-opening periods (pulse widths) of the intake passage injection valve 15 and the cylinder injection valve 16 based on predetermined conditions such as the amount of intake air before each stroke. Since the engine 10 according to the present embodiment is a 4-cylinder 4-stroke engine, a phase difference of 180 degrees in the crank angle in the respective cylinders coincides with the cycle of each stroke (exhaust stroke, intake stroke, compression stroke, expansion stroke) of the combustion cycle. Thus, the fuel injection amount in each stroke is computed based on the amount of intake air immediately before each stroke. In the present embodiment, the amount of intake air is detected with the air flow sensor 25, but can be obtained by computation based on the intake pressure, intake temperature or the like.

Figure 4:
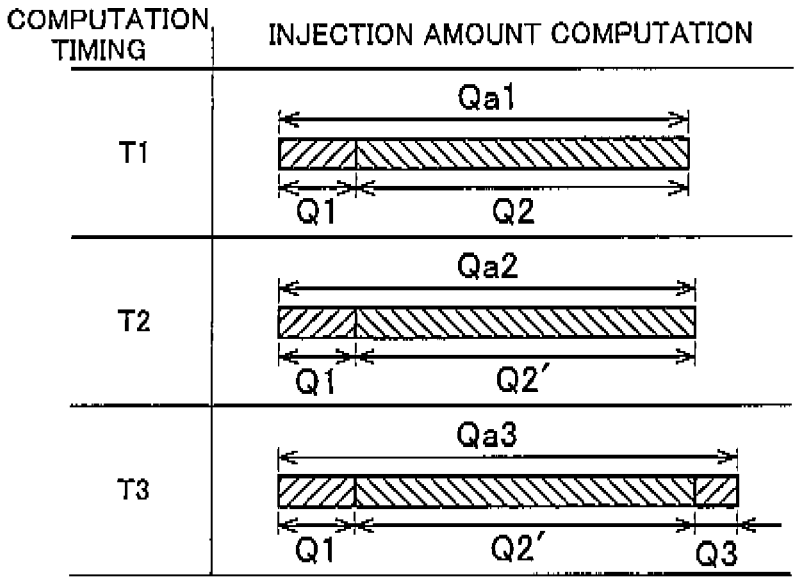
FIG. 4 is a view illustrating an example of methods for computing the fuel injection amounts.

In the present embodiment, a fuel amount Q1 to be injected from the intake passage injection valve 15 and a fuel amount Q2 to be injected from the cylinder injection valve 16 are computed, for example, based on an intake air amount A1 at a timing T1 after the expansion stroke (immediately before the exhaust stroke). Concretely, as shown in FIGS. 3A, 3B and 4, a first task is to compute a required fuel amount Qa1 from the intake air amount A1 at the timing T1. The required fuel amount refers to the amount of fuel necessary for one combustion cycle (the sum of the injection amount of the intake passage injection valve 15 and the injection amount of the cylinder injection valve 16).

The fuel amount Q1 to be injected from the intake passage injection valve 15 and the fuel amount Q2 to be injected from the cylinder injection valve 16 are computed based on the required fuel amount Qa1 and the aforementioned injection amount ratio between the intake passage injection valve 15 and the cylinder injection valve 16. Concretely, if the injection amount ratio between the intake passage injection valve 15 and the cylinder injection valve 16 is A:B, the fuel amount Q1 to be injected from the intake passage injection valve 15 is calculated from the required fuel amount Qa1×A/(A+B), while the fuel amount Q2 to be injected from the cylinder injection valve 16 is calculated from the required fuel amount Qa1×B/(A+B). The fuel injection control means 52 opens the intake passage injection valve 15 for a predetermined valve-opening period so that the fuel amount Q1 is achieved in the exhaust stroke. If the operating state of the engine 10 is a steady state, moreover, the fuel injection control means 52 opens the cylinder injection valve 16 for a predetermined valve-opening period so that the fuel amount Q2 is obtained in the intake stroke (see FIG. 3A).

If the operating state of the engine 10 is a transient state, for example, if the operating state of the engine 10 shifts from the first operating region D1 to the second operating region D2, a required fuel amount Qa2 is computed based on an intake air amount A2 at a timing T2 after the exhaust stroke (immediately before the intake stroke). The fuel amount Q1 injected from the intake passage injection valve 15 in the exhaust stroke is subtracted from the required fuel amount Qa2 to obtain a fuel amount Q2' to be injected from the cylinder injection valve 16 in the intake stroke (see FIG. 4). The fuel injection control means 52 opens the cylinder injection valve 16 for a predetermined valve-opening period so that the fuel amount Q2' is achieved in the intake stroke (FIG. 3B). This procedure compensates for an increase in the required fuel amount associated with a change in the operating state of the engine 10 between the timings T1 and T2.

If the operating state of the engine 10 shifts from the first operating region D1 to the second operating region D2, a required fuel amount Qa3 is further computed based on an intake air amount A3 at a timing T3 after the intake stroke (immediately before the compression stroke). The fuel amount Q1 injected in the exhaust stroke and the fuel amount Q2' injected in the intake stroke are subtracted from the required fuel amount Qa3 to obtain a fuel amount Q3 to be additionally injected in a first half of the compression stroke. In other words, the additional fuel amount Q3 is an increase in the required fuel amount associated with a change in the operating state of the engine 10 between the timings T2 and T3.

The fuel injection control means 52 opens the cylinder injection valve 16 for a predetermined valve-opening period so that the additional fuel amount Q3 is injected in the first half of the compression stroke (see FIG. 3B). That is, the increase in the required fuel amount in the intake stroke is supplemented with injection from the cylinder injection valve 16 in the first half of the compression stroke. In this manner, a series of fuel injections in one combustion cycle is completed.

The valve-opening periods (pulse widths) of the intake passage injection valve 15 and the cylinder injection valve 16 are computed based on the fuel amounts determined by the above computations, as well as the pressures of fuel (fuel pressures) to be supplied to the intake passage injection valve 15 and the cylinder injection valve 16. The intake passage injection valve 15 is supplied with fuel at a nearly constant pressure by the low pressure supply pump 18. If the fuel amount is constant, therefore, the valve-opening period of the intake passage injection valve 15 is also constant.

On the other hand, the cylinder injection valve 16 is supplied by the high pressure supply pump 21 with fuel at a predetermined pressure which is higher than the fuel pressure of the intake passage injection valve 15 and which is conformed to the operating state of the engine 10. In the present embodiment, fuel is supplied to the cylinder injection valve 16 in such a manner as to reach a first fuel pressure or a second fuel pressure. Thus, the valve-opening period of the cylinder injection valve 16 changes, as appropriate, according to a change in the fuel pressure, even when the amount of fuel injected is constant. Such a fuel pressure of the cylinder injection valve 16 is adjusted, as appropriate, by the fuel pressure adjustment means 53.

The fuel pressure adjustment means 53 controls the working state of the high pressure supply pump 21 in accordance with the operating state of the engine 10, namely, the detection results of the operating state detection means 51, to adjust the fuel pressure of the cylinder injection valve 16. Concretely, the fuel pressure adjustment means 53 controls the working state of the high pressure supply pump 21 such that the fuel pressure of the cylinder injection valve 16 becomes the first fuel pressure, if the operating state of the engine 10 is in the first operating region D1, namely, if the "MPI injection mode" is selected. If the operating state of the engine 10 is in the second operating region D2, namely, if the "MPI+DI injection mode" is selected, the fuel pressure adjustment means 53 controls the working state of the high pressure supply pump 21 such that the fuel pressure of the cylinder injection valve 16 becomes the second fuel pressure.

In the present embodiment, the first fuel pressure is set to be higher than the fuel pressure of the intake passage injection valve 15. However, the first fuel pressure is not restricted if it is a fuel pressure enabling fuel to be directly injected from the cylinder injection valve 16 into the combustion chamber. For example, the first fuel pressure can be equal to the fuel pressure of the intake passage injection valve 15.

Further, if the operating state of the engine 10 shifts from the first operating region D1 to the second operating region D2, the fuel pressure adjustment means 53 adjusts the working state of the high pressure supply pump 21 such that the amount of fuel injection from the cylinder injection valve 16 stabilizes, before changing the working state of the high pressure supply pump 21 in accordance with the injection form (injection form). In the present embodiment, for example, the fuel pressure adjustment means 53 maintains the working state of the high pressure supply pump 21 for a predetermined period so that the amount of fuel injection from the cylinder injection valve 16 stabilizes. Concretely, if the operating state of the engine 10 shifts from the first operating region D1 to the second operating region D2, the fuel injection control means 52 switches the fuel injection mode from the "MPI injection mode" to the "MPI+DI injection mode". At this stage, however, the fuel pressure adjustment means 53 maintains the working state of the high pressure supply pump 21 to hold the fuel pressure of the cylinder injection valve 16 at the first fuel pressure. Then, if the state where the operating state of the engine 10 is in the second operating region D2 persists for a predetermined period or longer and the injection form is fixed, the fuel pressure adjustment means 53 changes the working state of the high pressure supply pump 21 to turn the fuel pressure of the cylinder injection valve 16 into the second fuel pressure.

By so controlling the fuel pressure of the cylinder injection valve 16, the amount of fuel injected from the cylinder injection valve 16 can be controlled highly accurately, regardless of the operating state of the engine 10.

Figure 5:
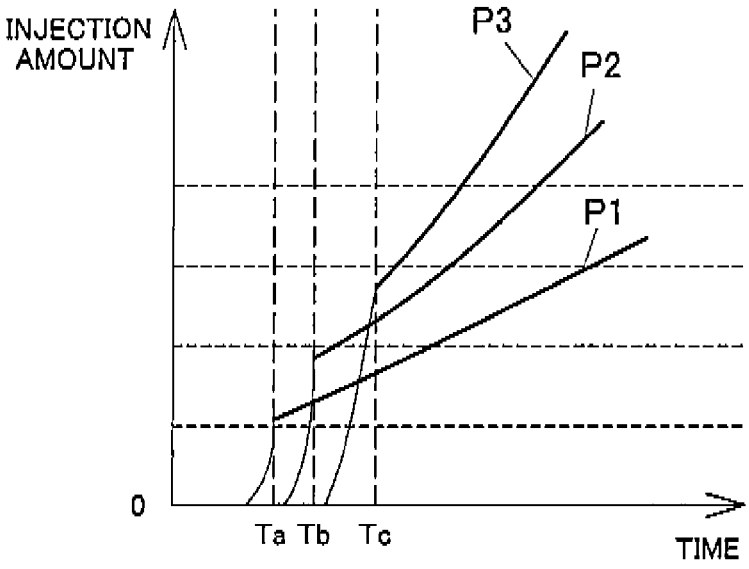
FIG. 5 is a view showing the relationship between the valve opening time and the injection amount for the fuel injection valve at different fuel pressures.

Generally, the fuel injection valve has an injection accuracy (linearity) stabilized by making its valve-opening time (pulse width) a predetermined time or longer. By controlling the valve-opening time of the fuel injection valve in such a region where the linearity stabilizes, the fuel injection amount can be controlled highly accurately. The predetermined time tends to lengthen as the fuel pressure increases. As shown in FIG. 5, for example, when the fuel pressure of the fuel injection valve is P1, the linearity stabilizes in a region where the valve-opening time is Ta or longer (the region is indicated by a heavy line in the drawing). When the fuel pressure of the fuel injection valve is P2 (>P1), on the other hand, the injection amount per unit time is larger than when the fuel pressure is P1, but the stability of linearity appears in a region where the valve-opening time is Tb (>Ta) or longer. When the fuel pressure of the fuel injection valve is P3 (>P2), moreover, the injection amount per unit time is larger than when the fuel pressure is P2, but the stability of linearity appears in a region where the valve-opening time is Ta (>Tb) or longer.

As these findings demonstrate, the higher the fuel pressure of the cylinder injection valve 16, the more fuel can be injected in a shorter time. Thus, when the operating state of the engine 10 shifts from the first operating region D1 to the second operating region D2, the fuel pressure of the cylinder injection valve 16 is increased simultaneously with the shift. By so doing, the amount of fuel injection from the cylinder injection valve 16 is rendered easier to increase in accordance with an increase in the required fuel amount. If, when the operating state of the engine 10 shifts from the first operating region D1 to the second operating region D2, the fuel pressure of the cylinder injection valve 16 is raised simultaneously with the shift, there is a possibility that a tiny fuel injection amount cannot be controlled highly accurately. For example, the aforementioned additional injection from the cylinder injection valve 16 involves a relatively small fuel injection amount, and thus its fuel injection amount may fail to be controlled with high accuracy.

However, when the operating state of the engine 10 shifts from the first operating region D1 to the second operating region D2, the working state of the high pressure supply pump 21 is maintained for a predetermined period, and the fuel pressure of the cylinder injection valve 16 is held relatively low, for example, whereby the valve-opening period becomes longer than in a usual practice. Thus, the valve-opening period (pulse width) of the cylinder injection valve 16 can be controlled in a region where the linearity becomes stable. Hence, even when a relatively small amount of fuel is injected from the cylinder injection valve 16, the fuel injection amount can be controlled with high accuracy.

The above predetermined period during which the working state of the high pressure supply pump is maintained may be determined, as appropriate, but is preferably longer than a period until the operating state of the engine 10 becomes a steady state, that is, a period during which additional injection from the cylinder injection valve 16 is executed. By this measure, the amount of fuel injection from the cylinder injection valve 16 can be controlled more reliably with high accuracy.

One embodiment of the present invention has been described above, but the present invention is in no way limited to this embodiment.

In the above embodiment, for example, the explanations have been offered for the feature that the high pressure supply pump can adjust the fuel pressure in two stages, i.e., the first fuel pressure and the second fuel pressure. However, the high pressure supply pump may be configured to be capable of adjusting the fuel pressure in three or more stages. In this case as well, when the operating state of the engine shifts from the first operating region to the second operating region, the working state of the high pressure supply pump is maintained for a predetermined period, whereby the fuel injection amount of the cylinder injection valve can be controlled with high accuracy.

If the high pressure supply pump can adjust the fuel pressure in three or more stages, when the operating state of the engine shifts from the first operating region to the second operating region, the working state of the high pressure supply pump is preferably adjusted such that a fuel pressure selected by the fuel pressure adjustment means from among fuel pressures at a plurality of stages is a fuel pressure stabilizing the fuel injection amount from the cylinder injection valve. Furthermore, it is preferred that the working state of the high pressure supply pump be maintained for a predetermined period so that the fuel pressure of the cylinder injection valve becomes the fuel pressure at the lowest stage. By so doing, the valve-opening period can be rendered longer, whereby the fuel injection amount of the cylinder injection valve can be controlled with high accuracy as mentioned above.

In the above embodiment, moreover, additional injection is executed from the cylinder injection valve in the first half of the compression stroke, but the timing of additional injection is not limited to the first half of the compression stroke. For example, it is permissible to carry out additional injection in the intake stroke.

In the above-described embodiment, the four-cylinder engine is illustrated to describe the present invention. However, the fuel injection control apparatus of the present invention can be adopted, for example, in a 3-cylindr or 6-cylinder engine. It is necessary to set the timing of computation of the fuel injection amount, as appropriate, in accordance with the number of the cylinders. No matter what the number of the cylinders is, the fuel injection amount can be controlled highly accurately, regardless of the operating state of the engine, as stated above.

EXPLANATIONS OF LETTERS OR NUMERALS

10 Engine (internal combustion engine)
11 Engine body

12 Cylinder (combustion chamber)
13 Intake manifold
14 Exhaust manifold
15 Intake passage injection valve (first fuel injection valve)
16 Cylinder injection valve (second fuel injection valve)
17 Low pressure delivery pipe
18 Low pressure supply pump
19 Fuel tank
20 High pressure delivery pipe
21 High pressure supply pump
22 Intake pipe (intake passage)
23 Throttle valve
24 Throttle position sensor (TPS)
25 Air flow sensor
26 Exhaust pipe (exhaust passage)
27 Three-way catalyst
28 $O_2$ sensor
29 Linear air-fuel ratio sensor (LAFS)
40 ECU

The invention claimed is:

1. A fuel injection control apparatus of an internal combustion engine, comprising:

a first fuel injection valve for injecting fuel into an intake passage of the internal combustion engine;

a second fuel injection valve for directly injecting fuel into a combustion chamber of the internal combustion engine;

a high pressure supply pump for supplying fuel to the second fuel injection valve so as to impart a predetermined fuel pressure higher than a fuel pressure of the first fuel injection valve, the predetermined fuel pressure including a first fuel pressure and a second fuel pressure higher than the first fuel pressure; and an electronic control unit including an input/output bus, a central processing unit, and a non-transitory memory that stores a computer program that causes the electronic control unit to:

detect an operation state of the internal combustion engine, the operation state including a steady state in which a load on the internal combustion engine is stable, and a transient state from a first operating region to a second operating region in which the load increases compared to the first operating region;

control the fuel injections, from the first fuel injection valve and the second fuel injection valve in accordance with the operating state of the internal combustion engine to change an injection form; and control a working state of the high pressure supply pump in accordance with the injection form to adjust the fuel pressure of the second fuel injection valve and, during the transient state, inject fuel from the second fuel injection valve at the first fuel pressure until the second operating region is maintained for a predetermined period of time or longer, before increasing the fuel pressure to the second fuel pressure.

2. The fuel injection control apparatus of an internal combustion engine according to claim 1, wherein the computer program causes the electronic control unit to maintain the working state of the high pressure supply pump for the predetermined period of time before changing the working state of the high pressure supply pump in accordance with the injection form, when the injection form has been changed.

3. The fuel injection control apparatus of an internal combustion engine according to claim 2, wherein the predetermined period of time includes a time in which the operating state of the internal combustion engine becomes a steady state, where the computer program causes the electronic control unit to maintain the working state of the high pressure supply pump during the predetermined period of time.

4. The fuel injection control apparatus of an internal combustion engine according to claim 1, wherein the computer program causes the electronic control unit to allow only the first fuel injection valve to inject fuel when the operating state of the internal combustion engine is in the first operating region defined by a rotation number and load of the internal combustion engine, and allow each of the first fuel injection valve and the second fuel injection valve to inject fuel when the operating state of the internal combustion engine is in the second operating region having higher rotation number and higher load than the first operating region; and the computer program causes the electronic control unit to adjust the working state of the high pressure supply pump such that the amount of fuel injection from the second fuel injection valve stabilizes, when the operating state shifts from the first operating region to the second operating region.

5. The fuel injection control apparatus of an internal combustion engine according to claim 2, wherein the computer program causes the electronic control unit to allow only the first fuel injection valve to inject fuel when the operating state of the internal combustion engine is in the first operating region defined by a rotation number and load of the internal combustion engine, and allow each of the first fuel injection valve and the second fuel injection valve to inject fuel when the operating state of the internal combustion engine is in the second operating region having higher rotation number and higher load than the first operating region; and the computer program causes the electronic control unit to adjust the working state of the high pressure supply pump such that the amount of fuel injection from the second fuel injection valve stabilizes, when the operating state shifts from the first operating region to the second operating region.

6. The fuel injection control apparatus of an internal combustion engine according to claim 3, wherein the computer program causes the electronic control unit to allow only the first fuel injection valve to inject fuel when the operating state of the internal combustion engine is in the first operating region defined by a rotation number and load of the internal combustion engine, and allow each of the first fuel injection valve and the second fuel injection valve to inject fuel when the operating state of the internal combustion engine is in the second operating region having higher rotation number and higher load than the first operating region; and the computer program causes the electronic control unit to adjust the working state of the high pressure supply pump such that the amount of fuel injection from the second fuel injection valve stabilizes, when the operating state shifts from the first operating region to the second operating region.

7. The fuel injection control apparatus of an internal combustion engine according to claim 4, wherein the high pressure supply pump adjusts the fuel pressure in a plurality of stages in accordance with the operating state of the internal combustion engine; and the computer program causes the electronic control unit to adjust the working state of the high pressure supply pump such that the fuel pressure selected from the plurality of stages becomes a fuel pressure at which the amount of fuel injection from the second fuel injection valve stabilizes, when the operating state of the internal combustion engine shifts from the first operating region to the second operating region.

8. The fuel injection control apparatus of an internal combustion engine according to claim 5, wherein the high pressure supply pump adjusts the fuel pressure in a plurality of stages in accordance with the operating state of the internal combustion engine; and the computer program causes the electronic control unit to adjust the working state of the high pressure supply pump such that the fuel pressure selected from the plurality of stages becomes a fuel pressure at which the amount of fuel injection from the second fuel injection valve stabilizes, when the operating state of the internal combustion engine shifts from the first operating region to the second operating region.

9. The fuel injection control apparatus of an internal combustion engine according to claim 6, wherein the high pressure supply pump adjusts the fuel pressure in a plurality of stages in accordance with the operating state of the internal combustion engine; and the computer program causes the electronic control unit to adjust the working state of the high pressure supply pump such that the fuel pressure selected from the plurality of stages becomes a fuel pressure at which the amount of fuel injection from the second fuel injection valve stabilizes, when the operating state of the internal combustion engine shifts from the first operating region to the second operating region.

10. The fuel injection control apparatus of an internal combustion engine according to claim 7, wherein the computer program causes the electronic control unit to maintain the working state of the high pressure supply pump such that the fuel pressure of the second fuel injection valve is a fuel pressure at a lowest stage.

11. The fuel injection control apparatus of an internal combustion engine according to claim 8, wherein the computer program causes the electronic control unit to maintain the working state of the high pressure supply pump such that the fuel pressure of the second fuel injection valve is a fuel pressure at a lowest stage.

12. The fuel injection control apparatus of an internal combustion engine according to claim 9, wherein the computer program causes the electronic control unit to maintain the working state of the high pressure supply pump such that the fuel pressure of the second fuel injection valve is a fuel pressure at a lowest stage.

13. The fuel injection control apparatus of an internal combustion engine according to claim 4, wherein the computer program causes the electronic control unit to allow the first fuel injection valve to inject fuel in an exhaust stroke, and also allow the second fuel injection valve to additionally inject fuel in an amount, which compensates for fuel injection from the first fuel injection valve in the exhaust stroke, in at least one of an intake stroke and a compression stroke, when the operating state of the internal combustion engine shifts to the second operating region.

14. The fuel injection control apparatus of an internal combustion engine according to claim 5, wherein the computer program causes the electronic control unit to allow the first fuel injection valve to inject fuel in an exhaust stroke, and also allow the second fuel injection valve to additionally inject fuel in an amount, which compensates for fuel injection from the first fuel injection valve in the exhaust stroke, in at least one of an intake stroke and a compression stroke, when the operating state of the internal combustion engine shifts to the second operating region.

15. The fuel injection control apparatus of an internal combustion engine according to claim 6, wherein the computer program causes the electronic control unit to allow the first fuel injection valve to inject fuel in an exhaust stroke, and also allow the second fuel injection valve to additionally inject fuel in an amount, which compensates for fuel injection from the first fuel injection valve in the exhaust stroke, in at least one of an intake stroke and a compression stroke, when the operating state of the internal combustion engine shifts to the second operating region.

16. The fuel injection control apparatus of an internal combustion engine according to claim 7, wherein the computer program causes the electronic control unit to allow the first fuel injection valve to inject fuel in an exhaust stroke, and also allow the second fuel injection valve to additionally inject fuel in an amount, which compensates for fuel injection from the first fuel injection valve in the exhaust stroke, in at least one of an intake stroke and a compression stroke, when the operating state of the internal combustion engine shifts to the second operating region.

17. The fuel injection control apparatus of an internal combustion engine according to claim 8, wherein the computer program causes the electronic control unit to allow the first fuel injection valve to inject fuel in an exhaust stroke, and also allow the second fuel injection valve to additionally inject fuel in an amount, which compensates for fuel injection from the first fuel injection valve in the exhaust stroke, in at least one of an intake stroke and a compression stroke, when the operating state of the internal combustion engine shifts to the second operating region.

18. The fuel injection control apparatus of an internal combustion engine according to claim 9, wherein the computer program causes the electronic control unit to allow the first fuel injection valve to inject fuel in an exhaust stroke, and also allow the second fuel injection valve to additionally inject fuel in an amount, which compensates for fuel injection from the first fuel injection valve in the exhaust stroke, in at least one of an intake stroke and a compression stroke, when the operating state of the internal combustion engine shifts to the second operating region.

19. The fuel injection control apparatus of an internal combustion engine according to claim 10, wherein the computer program causes the electronic control unit to allow the first fuel injection valve to inject fuel in an exhaust stroke, and also allow the second fuel injection valve to additionally inject fuel in an amount, which compensates for fuel injection from the first fuel injection valve in the exhaust stroke, in at least one of an intake stroke and a compression stroke, when the operating state of the internal combustion engine shifts to the second operating region.

20. The fuel injection control apparatus of an internal combustion engine according to claim 11, wherein the computer program causes the electronic control unit to allow the first fuel injection valve to inject fuel in an exhaust stroke, and also allow the second fuel injection valve to additionally inject fuel in an amount, which compensates for fuel injection from the first fuel injection valve in the exhaust stroke, in at least one of an intake stroke and a compression stroke, when the operating state of the internal combustion engine shifts to the second operating region.

* * * * *